United States Patent [19]

Lindström

[11] 3,963,592

[45] June 15, 1976

[54] METHOD FOR THE ELECTROLYTIC PRODUCTION OF ALKALI

[75] Inventor: Olle Lindström, Taby, Sweden

[73] Assignee: Hooker Chemicals & Plastics Corporation, Niagara Falls, N.Y.

[22] Filed: Sept. 30, 1974

[21] Appl. No.: 510,210

Related U.S. Application Data

[62] Division of Ser. No. 293,623, Sept. 29, 1972, Pat. No. 3,864,236.

[52] U.S. Cl. ..... 204/98; 204/103; 204/128; 204/129; 136/86 F

[51] Int. Cl.[2] ..... C25B 1/16; C25B 1/02; C25B 1/26; C25B 1/22

[58] Field of Search ..... 204/103, 98, 128, 129, 204/292; 136/86 F

[56] References Cited

UNITED STATES PATENTS

| | | | |
|---|---|---|---|
| 3,124,520 | 3/1964 | Juda | 204/103 |
| 3,282,834 | 11/1966 | Justi et al. | 204/103 |

*Primary Examiner*—R. L. Andrews
*Attorney, Agent, or Firm*—Peter F. Casella; Herbert W. Mylius

[57] ABSTRACT

A method whereby an alkali, such as an alkali metal hydroxide, is produced at the cathode by the electrolysis of aqueous alkali metal halide solutions and the process is operated to produce either chlorine or HCl at the anode.

2 Claims, 6 Drawing Figures

METHOD FOR THE ELECTROLYTIC PRODUCTION OF ALKALI

This application is a divisional application of Ser. No. 293,623, filed Sept. 29, 1972, now U.S. Pat. No. 3,864,236.

This invention relates to a process for the electrolytic production of an alkali metal hydroxide and more particularly it relates to a process for the electrolytic production of alkali metal hydroxides which permits variation in the type of anodic reaction products which are concurrently produced.

Alkaline materials, and particularly sodium hydroxide and potassium hydroxide, are frequently produced by the electrolysis of aqueous alkali metal chloride solutions. In this process, the alkali is formed at the cathode while chlorine is formed at the anode. Additionally, hydrogen is also formed at the cathode but this material is generally considered to be a waste product.

Unfortunately, the commercial demands for chlorine and alkali are generally not in the same proportions as the quantities in which these chemicals are formed by this electrolytic decomposition of the alkali metal chloride solutions. Thus, where the demand for chlorine is less than the demand for alkali, some other use must be found for the excess chlorine which is produced. In some instances, it has been proposed to react this excess chlorine with hydrogen to form hydrogen chloride gas which is then aborbed in water to form hydrochloric acid. This technique, however, is not extremely attractive since the electrochemical decomposition of the alkali chloride requires large quantities of electrical energy whereas the energy recovery at the hydrogen-chlorine reaction is expensive and, further, involves corrosion problems.

The present invention involves a method for the production of alkali by electrolysis of an aqueous alkali chloride solution. The electrolysis is carried out in a cell containing negative electrodes, where the alkali is formed and positive electrodes where either elemental hydrogen is oxidized to hydrogen ions which can form hydrochloric acid with the chloride ions present in the electrolyte or elemental chlorine is formed by the oxidation of the chloride ions at the same positive electrodes, in which latter case there is no hydrogen supply to the positive electrodes. By this method, it is possible to adjust the production of chlorine and the alkali so as to meet the commercial requirements of these chemicals while minimizing the consumption of electrical energy.

In the process of this invention, components may be used in the electrolytic process which are known to those in the art. In this connection, however, a new and improved anode is of particular advantage. The negative electrode used may be of the type which is used in vertical chlorine-alkali cells or, it may be an air cathode, such as that used in fuel cells. The anode and the cathode may be separated by permeable diaphragms, such as asbestos diaphragms, as well as by semipermeable ion exchange membranes, such as those described in U.S. Pat. No. 3,262,868. Additionally, the anodes used may be hydrogen anodes of the type used in acid hydrogen air fuel cells. The life of anodes of this type is, however, quite short when they are used for the production of chlorine in accordance with the method of the present invention.

To overcome this difficulty, it has been found that in the cells of the present invention, the anode may be formed of the same type of electrode materials which are presently used for metallic anodes in chlorine-alkali cells.. These electrode materials, for example, contain titanium metal activated with various catalysts, such as platnium, ruthinium oxide, and the like. These anodes must, however, as will be described in detail hereinafter, be fabricated in a different way, as compared to the known metallic anodes, in order to make it possible to carry out the alternative electrolysis in accordance with the present method. In this regard, it is to be noted that the anodes used in the method of the present invention must be capable of working efficiently both as a hydrogen anode and as a chlorine anode. In this manner, it is possible, depending upon the particular market situation, to produce hydrogen chloride in the anolyte at a very low cell voltage or, alternatively, to produce chlorine at the anode. In the latter case, the cell will be operated as a conventional chlorine-alkali cell, by interrupting the hydrogen supply to the anode and venting the hydrogen which is developed at the cathode in the conventional manner. While this conversion to chlorine production is, in principle, possible with all type of hydrogen anodes, including carbon anodes, the metallic anodes, such as titanium anodes have been found to be particularly suitable for this purpose.

A particularly advantageous embodiment of the invention is the use of air-cathode in the cell. Such a cell may, when hydrogen and air are introduced, be described as a hydrogen air cell with an acid anolyte and an alkaline catholyte in which the alkali metal ions becomes concentrated in the catholyte and the chloride ion is present in the anolyte. In the alternative mode of operation, the cell may be described as a chlorine-alkali cell with an air-cathode.

It is to be appreciated that the electrolysis cell used in the method of the present invention may include many different embodiments. Thus, there are many different types of primary cells for chlorine-alkali electrolyses as well as many different types of hydrogen electrodes for use in acid-water solutions. Typical of the primary cells for chlorine-alkali electrolysis are those described in the Kirk-Othmer "Encyclopedia of Chemical Technology", Second Edition, Volume 1, Pages 668 – 707. Similarly, typical hydrogen electrodes which may be used are those described in H. A. Liebhafsky and E. J. Cairns: "Fuel Cells and Fuel Batteries", John Wiley & Sons, Inc., New York 1968.

In the operation of the cells of the present invention, it has frequently been found that, during the operation with hydrogen supplied to the anode, the current density on the anode is a limiting factor. Accordingly, it has been found to be advantageous to use planar electrodes which furnish a large surface area in a given cell volume. Additionally, it has been found that the electrodes should desirably have their current conducting surfaces vertically oriented so as to avoid the development of gas pockets which further hinder the electrolytic current. Thus, the preferred cells of the present invention are those in the class of vertical diaphragm cells, having mainly planar electrodes. A particularly suitable cell configuration has been found to be the filter press concept, which has heretofore been used in units for both chlorine and -alkali electrolysis and in fuel cell systems. In the drawings which are attached hereto and form a part hereof, reference is made to cells of this type with both monopolar electrodes and bipolar electrodes.

Figure 1:
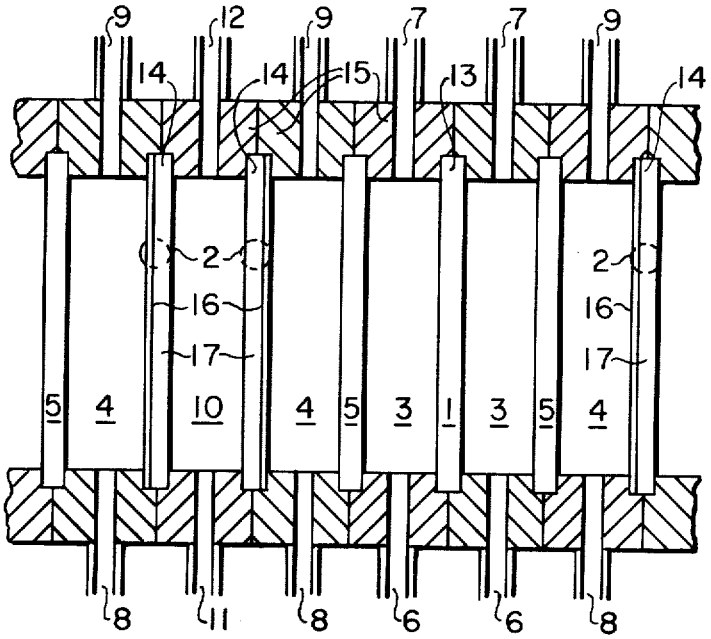
FIG. 1 illustrates a cell of the filter press type having a monopolar electrode.

Referring now to FIG. 1, this is a schematic representation of a cell of the filter press type having a monopolar electrode. The cathodes 1 and the anodes 2 where chlorine is developed or alternatively hydrogen ions are formed are vertically arranged. The cathode spaces 3 are separated from the anode spaces 4 by means of a diaphragm 5 which may also be a cation permeable membrane. The anode spaces contain an acid solution of alkali chloride in water (the anolyte) which is supplied through the pipes 8 and let out through the pipes 9. In a similar way the cathode spaces are supplied with a solution of the corresponding alkali hydroxide and water (the catholyte) through the pipes 6. The catholyte is let out through the pipes 7. The hydrogen in the catholyte is separated and conducted to a system for hydrogen supply which is not shown in the figure, this system contains means for control of pressure and flow of the hydrogen gas to the anode. The catholyte is also supplied with water which is consumed in the cathode reaction. The catholyte which is let out of the system is processed further, for instance by evaporation or the like.

When the cell is operated on hydrogen the hydrogen gas is supplied to the gas spaces 10 through the pipes 11 and let out through the pipes 12. The chlorine which is developed at the anode when the cell is used for chlorine production is let out through the pipes 9 together with the anolyte but it may also, wholly or partly, leave to the gas space 10. The chlorine gas is separated by separating means that are not shown and is thereafter piped for further processing or storage. The electrical connection takes place by means of the current conductors 13 and 14.

The anolyte, which has lost part of its content of alkali chloride in the electrolytic process is recycled to the anode spaces after addition of alkali chloride in a special dissolver when the cell is used for chlorine production. When the cell is operated on hydrogen the anolyte may be processed further depending on the market situation. It is sometimes advisable to produce hydrogen chloride and sodium sulfate by reaction with sulfuric acid. Sodium chloride may also be separated by evaporation and crystallization for recycle to the process. In the description that follows below, for simplicity, only the operation with hydrogen anodes is set forth.

It is frequently not possible to keep anolyte and catholyte completely separated and then the catholyte gets a certain content of alkali chloride. The alkali chloride may be removed in a known manner by crystallization whereafter the alkali chloride is supplied to the dissolver in the anolyte circuit. Water is consumed in the cathode reaction and therefore water is supplied to the catholyte. The net quantity of alkali hydroxide formed is recovered by means of a flow of a circulating catholyte which is piped away for further processing for instance evaporation to dryness.

The functional cell elements, that is cathodes, anodes and separators, are arranged in electrically isolating frames 15 which are pressed together to form a pile or a filter press like structure. This pile can also contain elements for other functions than those mentioned above, for instance cooling or heating. Tightness between the frames can be obtained by means of special gaskets of rubber or the like. Supporting elements are frequently required to distribute the pressure from the end-plates and to support the electrodes. The frames can also be welded, glued or joined together in other ways whereby special endplates for the pile in certain cases can be dispensed with. These frames may advantageously be made of a polymer material which is resistant to the chemicals present. Penton, Teflon, PVC, Kel-F, polypropylene, chlorine and alkali resistant rubber are examples of such materials. The cross-section of the pile can be circular, square, rectangular or have another shape. The pipes for the process media can be completely or partly arranged as channels in the frames with connections to each cell space by means of so called bi-channels which end directly in the space around the pile. For obvious reasons, however, in such cases the simultaneous out-flow of process media is limited to those which are inert towards each other. For an embodiment of this kind it is apparently desirable and sometimes necessary (for instance when there is a free out-let of chlorine) to arrange the pile in a special container which in such a case must be equipped with the necessary couplings, joints, conductors and other auxiliary functions. Such a vessel may contain several piles arranged in several decks.

The electrodes may be joined in parallel in groups which in their turn may be joined in series. The current conductors which are necessary for this purpose and auxiliary electrical connections are not shown in the figures. These current conducting elements may be contained in special ducts in the frames or may be arranged outside the pile.

The anodes 2 contain a porous sintered coarse layer composed of for instance platinized titanium metal 16 on which layer a finer layer is arranged which contains non-activated titanium which exposes its surface to the electrolyte 17. The coarse layer is partly filled with hydrogen when it is in operation.

Figure 2:
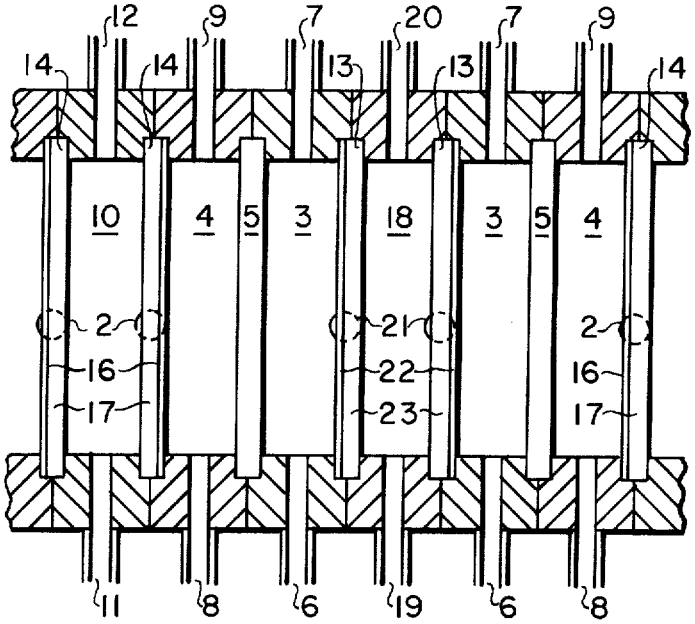
FIG. 2 illustrates a cell using two layer air cathodes.

The cell according to FIG. 1 may use a conventional cathode, made for instance of iron, where hydrogen is developed. It is, however, also possible to use two layer air cathodes. This embodiment of the invention is shown in FIG. 2. The air space 18 is supplied with air by the pipe 19, the excess air leaves through the pipe 20. The air cathodes 21 contain a coarser active layer 22 and a finer protective layer 23, which layer thanks to the capillary forces prevents air leakage into the catholyte spaces.

The separating means may also, particularly when both electrodes are gas diffusion electrodes, be made by a porous body of asbestos or by some other kind of compacted or sintered, resistant materials, which completely fills up the space between the anodes and the cathodes. Special fine layers on the electrodes may therefore be disposed of if the layers on the electrodes may therefore be disposed of if the pores in the separating means in this particular embodiment are made so small that the gas pressure in the air and the hydrogen spaces do not overcome the capillary forces in the separating means filled up with electrolyte. In another embodiment, the diaphragm may be arranged directly on the electrodes, as in Swedish patent 216659, where the alkali hydroxide seeps out into the air space to be conducted away at the bottom of this space. In this particular case it is of advantage to supply the water which is consumed in the air cathode in the form of water vapour in the supplied air.

The carbon dioxide present in the air which is carried to the air spaces in the cell in FIG. 2, can be removed for instance in an alkaline scrubber. This is, however, not necessary when carbonate can be tolerated in the product. The in-going air can with advantage be preheated by heat exchange with out-going air. It may also be of advantage in certain cases when cheap oxygen is available to increase the oxygen content of the air by addition of oxygen or to substitute an oxygen flow for the air flow. With certain types of cathodes this will give a most considerable improvement of electrode performance.

Figure 3:
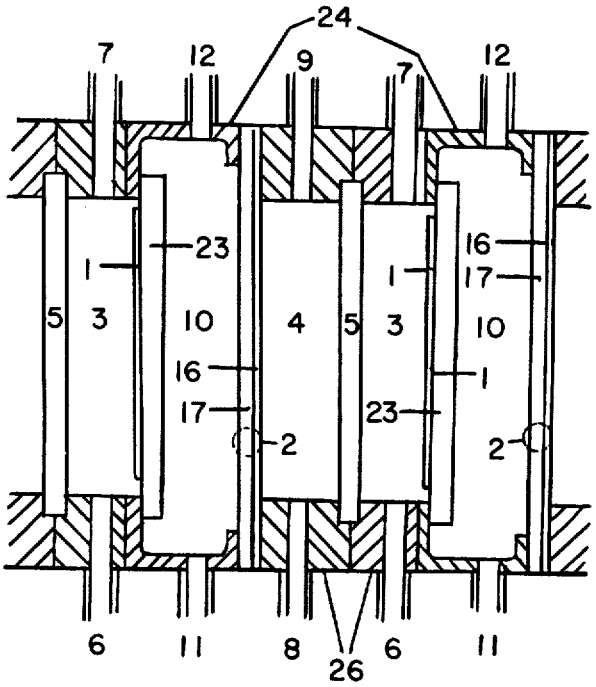
FIGS. 3 and 4 show modifications with bipolar electrodes of the cell concepts in FIG. 1 and FIG. 2.
Figure 4:
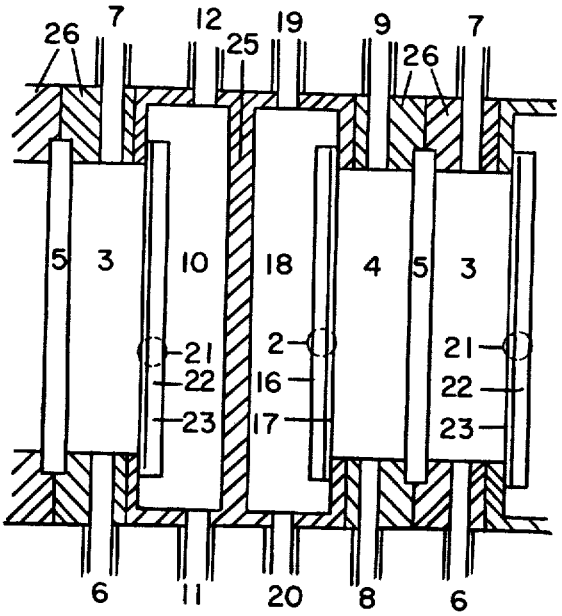

FIGS. 3 and 4 show modifications with bipolar electrodes of the cell concepts in FIG. 1 and FIG. 2. The main difference between the embodiments according to FIG. 1 and FIG. 3 is that the current conductors 13 and 14 in FIG. 1 are replaced with an electrically conducting separating wall which connects electrically the active electrode material in the anode and the cathode. This known principle for bipolar electrodes can be used for instance by having the separating wall made of a thin plate of titanium 23 which is activated with an iron layer 1 on its catholyte side. The anodes and the cathodes are welded together peripherically by means of for instance electron beam welding to the element 24 which has the shape of a ring with flanges. The element 24 which can be formed by pressing a nickel plate to this shape contains connections for air, 11 and 12, welded to the element.

FIG. 4 shows a bipolar arrangement with an anode of the same kind as in FIG. 2. The gas spaces 10 and 18 are arranged between the separating wall 25 and the porous anode 2 with the coarse layer 16 and the fine layer 17 respectively the porous air cathode 21 with the layer 22 and the fine layer 23. The separating wall 25 contains flanges to which anode and cathode are welded according to the example in FIG. 3. The element is preferably fabricated in titanium.

Bipolar electrodes with the necessary connections for air, and the like are stacked in the same manner as has been indicated above for the monopolar electrodes to a pile which is kept together by end-plates and bolts in the known manner. Electrically isolating auxiliary elements 26 are arranged between the electrode elements which together with the electrode elements separate the electrolyte spaces. These auxiliary elements are preferably equipped with the connections for anolyte, catholyte, and the like.

The cathode material in FIG. 1 and FIG. 3 may be iron, e.g. an iron plate. The air cathode for FIG. 2 and 4 can be made of many different materials such as active carbon, nickel etc. according to the state of art. It may be hydrofobic with particles of Teflon or other hydrofobic materials arranged in the porous electrode structure. One type of air cathode works with two porous layers, one fine layer exposed to the electrolyte and one coarse active layer. The catalyst is arranged in the coarse layer which when in operation is partly filled up with air. Silver in a concentration of 1–10 mg silver/cm$^2$ may serve as a catalyst. The electrode can be made of a mixture of catalyst, carbonyl-nickel powder and spacer which are pressed and sintered to the desired porosity, frequently is 50–70%, at a sintering temperature of say 800°C. The fine layer which does not contain catalyst and spacer is first put into the mold. The powder for the coarser layer is then put on top of this layer and the sand which is pressed for instance at 1 ton/cm$^2$. The corrosion resistance can be improved considerably in the known manner by developing a semi-conducting lithiated nickel oxide on the electrode surfaces. These air cathodes may also operate as conventional electrodes by interruption of the air supply. It is then possible to fill up the air space with catholyte or to permit the hydrogen gas formed to build up a suitable differential pressure so as to keep the air spaces filled with hydrogen.

Porous titanium anodes of the two-layer type are made in a completely analogous manner with methods which are known in the art of making porous bodies of titanium (Kirk-Othmer "Encyclopedia of Chemical Technology", 2nd Edition, Volume 20, page 347–379). It is also suitable to use hydrophobic hydrogen electrodes of the kind used in fuel cells operating with phosphoric acid as electrolyte at 100–150°C. The hydrogen electrode may also be a thin street of Pd-Ag alloy permeable to hydrogen.

In order to further improve the corrosion resistance of the titanium structure, when the anode is operated with the addition of hydrogen, a protective layer of a tungsten bronze may be deposited on the structure, such as that described in the published German patent application 2,054,963. The corrosion resistance of the titanium may also be further improved by alloying with nickel or palladium.

A very efficient separating means comprises a cation permeable ion exchange membrane which contains a condensate of phenol sulfonic acid and formaldehyde for instance according to the Swedish patent 156,526. As was mentioned above a cation permeable membrane may be combined with an anion permeable one and an intermediate brine space. It is also possible to use diaphragms of the kind which are used in vertical electrolysis cells according to the state of art. These separating means can be built up directly on the electrodes for instance as has been described in the Swedish patent 216659.

In order to describe the present invention further, one embodiment which is related to one of the cell concepts described in the FIGS. 1, 2, 3 and 4 will be described in somewhat more detail. The invention is, however, not limited to the particular embodiments that are described in the FIGS. 1–4 and therefore the following description does not indicate limitations in the invention. The purpose is simply to exemplify one out of several possible embodiments of the invention. The following embodiment relates to FIG. 1 and makes use of activated titanium anodes, two-layer air cathodes and ion exchange membranes according to the Swedish patent 156526. The cell has further a free out let of anolyte and chlorine.

The titanium anode for this cell has the dimension 111 × 225 mm which gives the total anode surface of 250 cm$^2$. The thickness is 0.8 mm out of which 0.3 mm serves as a fine layer with 50% porosity and pores with a size of about 10 mm. The coarse layer which thus is 0.5 mm thick contains coarser pores with an average size of 25 mm and a catalyst concentration of a milliliter of nobel metal per square centimeter. The noble metal catalyst may be formed of oxides of platnium, iridium, ruthinium or the like, either alone or as mixtures of these. Activation may take place by vapor phase deposition. Prior to activation, a protective layer of sodium tungstinate may be formed on the titanium surface, such as described in the published German patent application 2,054,963. This anode operates at 0.2 bar pressure difference in the hydrogen mode.

Under these conditions the electrode operates at a potential of about +0.1 volt against the hydrogen reference electrode in 1-N hydrogen chloride at 110 mA/cm². The anodes are connected in a gas tight manner to frames of Peton according to FIG. 5. The anode may be connected to frame for instance by direct welding of the polymer against the fine layer of the anode at its periphery. Current conducting titanium plates are contact-welded towards the coarse layer of the anode in its upper edge. Two such frames are welded together by melting the plastic frames in their periphery. This forms a gas space between the two anodes. This gas space has a thickness of 0.8 mm and contains a support which conducts the hydrogen gas from its inlet to its outlet in such a manner that the gas comes into contact with the whole surface of the anode. The current conductors are also carried through the frame in a gas tight manner. This can be accomplished for instance by means of high frequency heating of the current conductor which melts the polymer material in contact with the titanium plate which makes it adhere to the plate.

Figure 5:
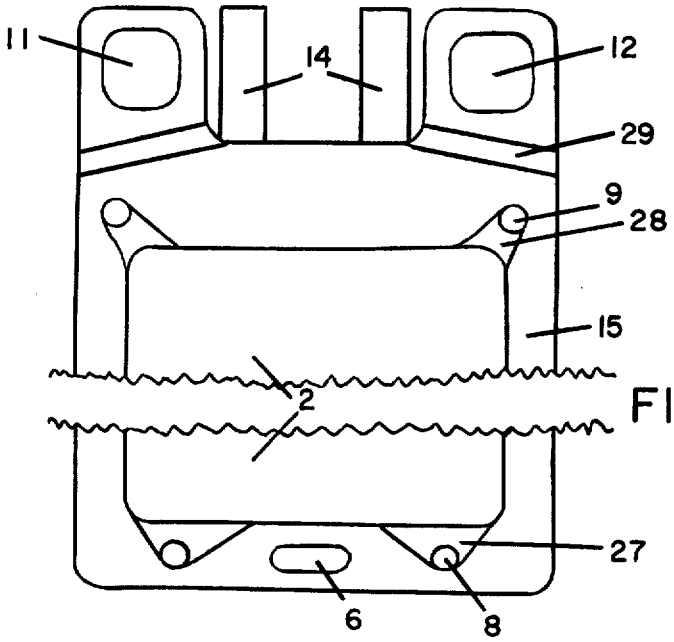
FIG. 5 shows a hydrogen element seen from an anolyte space.

FIG. 5 shows a hydrogen element according to the above description seen from an anolyte space. We are using the same notifications as earlier and thus the anode is designated 2, the two current conductors, one for each anode 14, the polymer frame 15 the gas ducts 11 and 12 and the channels for in-going anolyte 8 and out-going anolyte 9 and the channel for in-going catholyte 6. The anolyte channels 8 and 9 are connected to the catholyte space by means of the bi-channels 27 and 28 which are made as grooves in the polymer frame. The channel 29 made as a groove in the frame serves to drain the space between the gas channels.

The cathode elements have basically the same shape as the anode elements. The cathode 1 in the form of an 0.8 mm iron plate and with the current conductor 13 is built into its frame when the latter is fabricated by injection molding whereby a gas-tight bond is formed towards the space between the channels. The catholyte is supplied to the catholyte space from the channel 6 through the bi-channel 30 formed as a groove in the polymer frame. Catholyte and hydrogen leave directly to the surroundings via the bi-channels 31.

The cation permeable membrane has the same outer shape as the cathode element according to FIG. 5 with holes punched for the various channels. Membranes are arranged between all anode and cathode elements. The membranes serve simultaneously as gaskets. The membrane can by advantage be supported by supporting structures in the two electrolyte spaces, for instance so called Netlon.

Anode elements, membranes and cathode elements are stacked to a pile containing 80 anodes and 160 cathodes, electrically joined in 20 series coupled groups with four parallel anodes and eight parallel cathodes in each group. Each group is separated by a blind cathode frame with a polymer disc instead of the cathode. By minimization of channel dimensions the current leakage may be kept at a level of only a few %. The pile ends in two end plates of polymer coated metal. The plates are drawn together by means of bolts which are arranged in an electrically isolated manner outside the pile. Variations in the length of the pile because of temperature variations are taken care of by feather discs, etc. All components outside the pile are painted with a chlorine resistant polymer. The same is the case with current conductors and electrical couplings. All connections are arranged at one end plate. The channels end blindly in the other end plate.

An alternative embodiment with regard to the transport-ways for the process media is to arrange the anolyte with a free out-let in the vessel and instead to carry the hydrogen gas in pipes together with the catholyte. All process media may also be completely encapsulated.

The total electrode area exposed to current is 0.2 m²/group and 4m²/pile. With the current density of 110 mA/cm² this gives a total current of 220A. The hydrogen flow is then 0.00005 kg/sec. A 20% solution of sodium chloride in water is fed to the anode space in a flow amounting to 0.02 kg/sec. counted on the whole pile. About 75% of the added chloride is decomposed. The cathode spaces are supplied with a flow of weak sodium hydroxide solution for instance 0.071 kg/sec. of solution with 4% sodium hydroxide. The outflow may be 0.085 kg/sec. of a 20% solution corresponding to 0.017 kg/sec. produced sodium hydroxide per pile or slightly more than 1 ton/day of sodium hydroxide for a battery of eight piles.

The cell voltage amounts to about 1 Volt per group in the above example whereby the energy consumption for production of 1 ton alkali amounts to about 1000 kWh, which is considerably below electrolysis according to state of art. The cell temperature in this case amounts to about 50°C. With a higher cell temperature, say 70°–90°C. The energy consumption is reduced further mainly because the lower polarization of the air cathodes.

Piles of the kind described above are arranged in closed vessels. These closed vessels or boxes may contain several piles which are electrically joined in series or in parallel. The process flows are, however, in general coupled in parallel. Such a vessel may thus contain 16 electrically parallel coupled piles whereby the current amounts to 3500 A. Since the voltage for one pile amounts to about 20 Volt the power requirement in this is 70 kW direct current for the production of 2 ton/day of hydrogen chloride and 2 ton/day of sodium hydroxide whereby about 4 ton sodium chloride is consumed. A vessel containing these 16 piles arranged in four decks with 4 piles in each deck has a bottom area of 1m × 1 m and a total height of 1.5 m. All connections are made via the cover of the vessel.

Floor area requirements are therefore of the magnitude of about 1 m²/day ton alkali which is several times less than the requirement for vertical diaphragm cells and of course much less than with horizontal mercury cells. These circumstances and the fact that the cells are built of a large number of similar elements which can be mass-produced means a smaller total investment than with the chlorine alkali electrolysers of the state of art. The low investment cost and the low energy requirements contribute to an extremely good process economy.

Figure 6:
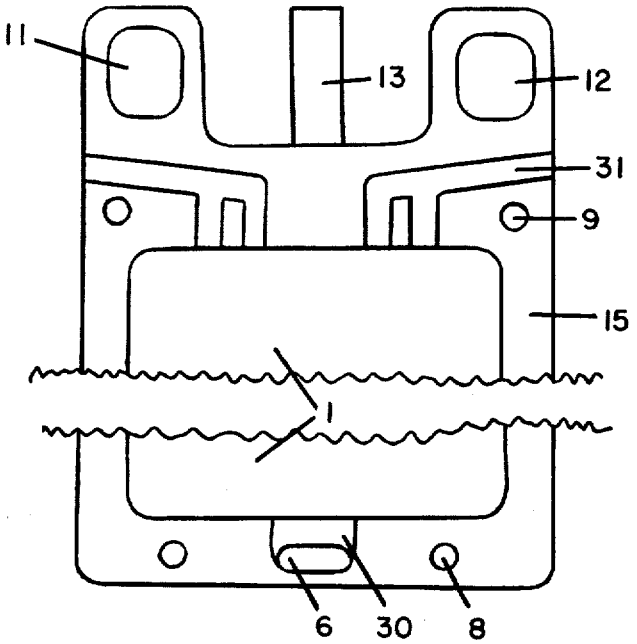
FIG. 6 shows a cathode element made in the same way as the anode element of FIG. 5 but with two layer air cathodes instead of anodes.

An embodiment according to FIG. 2 can easily be developed from that shown in FIG. 5 and 6. The cathode element according to FIG. 6 is then made in principle in the same way as the anode element according to FIG. 5 but with two layer air cathodes instead of the anodes. Furthermore channels for in- and out-going air have to be added which may be placed in the lower part of the frame.

What is claimed is:

1. In the process for electrolyzing an aqueous solution of an alkali metal chloride to form an alkali metal hydroxide at the cathode and chlorine at the anode by the oxidation of chloride ions in the anolyte, the improvement which comprises introducing hydrogen gas at the anode, preferentially anodically oxidizing said hydrogen gas in the presence of a catalyst to hydrogen ions by passing said hydrogen gas through a porous anode containing the catalyst into the anolyte and reacting the thus-formed hydrogen ions with the chloride ions in the anolyte, the porous anode through which the hydrogen gas is passed being formed in two layers, said first layer being a porous sintered coarse layer of platinized titanium and said second layer being a porous sintered finer layer of titanium, the hydrogen gas being passed initially through said first layer and then through said second layer into the anolyte.

2. The process as claimed in claim 1 wherein the hydrogen gas introduced at the anode is at least partially supplied by hydrogen gas formed at the cathode.

* * * * *